US006321411B1

(12) United States Patent
Ikejiri et al.

(10) Patent No.: US 6,321,411 B1
(45) Date of Patent: Nov. 27, 2001

(54) DOORSTOP DEVICE

(76) Inventors: Shigeki Ikejiri, 1743, Goromaru, Miyanojin-machi, Kurume-shi, Fukuoka-ken; Teruyuki Kumadaki, 1722-5, Umemitsu-machi, Kurume-shi, Fukuoka-ken; Yoshihiko Hyakutake, 447-1, Izumi, Chikugo-shi, Fukuoka-ken, all of (JP)

( * ) Notice: Subject to any disclaimer, the term of this patent is extended or adjusted under 35 U.S.C. 154(b) by 0 days.

(21) Appl. No.: 09/587,694

(22) Filed: Jun. 5, 2000

(51) Int. Cl.[7] ..... E05F 5/02

(52) U.S. Cl. ..... 16/82; 16/85; 292/341.17; 292/DIG. 15

(58) Field of Search ..... 16/82, 85, 86 A, 16/86 B, 86 C; 292/DIG. 15, DIG. 19, 251.5, 342, 336, 341.17, 341.18

(56) References Cited

U.S. PATENT DOCUMENTS 3,578,370 * 5/1971 Greytok ..... 16/86 A
3,579,934 * 5/1971 Pietsch ..... 292/251.5
5,082,317 * 1/1992 Delaney, Jr. ..... 292/251.5
5,836,049 * 11/1998 Chiang ..... 16/82

FOREIGN PATENT DOCUMENTS 10-115139 * 5/1998 (JP) .
11-287062 10/1999 (JP) .
11-350821 * 12/1999 (JP) .
P2000-54714-A * 2/2000 (JP) .
P2000-192707-A * 7/2000 (JP) .
P2000-274132-A * 10/2000 (JP) .

* cited by examiner

*Primary Examiner*—Chuck Y. Mah
(74) *Attorney, Agent, or Firm*—Jordan & Hamburg LLP

(57) ABSTRACT

A doorstop device to automatically and securely fix the door to be retained at the same opened position comprises a door member 11 mounted on a bottom side of a door 10 and including a magnet 12 and an elastic fixing member 17, and a floor member 15 buried in a floor face 18 and having a movable piece 16 which is attracted to the magnet 12 and engages with the elastic fixing member 17. As the door opened, the movable piece 16 of the floor member 15 projects and attaches to the magnet 12 of the door member 11, and the elastic fixing member 17 presses and holds the movable piece 16, thereby fixing the door 10 to be retained at the same position.

17 Claims, 8 Drawing Sheets

DOORSTOP DEVICE

BACKGROUND OF THE INVENTION

The present invention relates to a doorstop device which fixes a door to an open position.

Various kinds of doorstop devices to retain a door at an open state at a predetermined angle have been developed heretofore. For example, a doorstop device comprising a combination of a magnet and a movable piece is disclosed in Unexamined Japanese Patent Publication No. 11-287062.

The above doorstop device comprises a door member which is mounted on a bottom side of a door and a floor member which is buried in a floor face under the route over which the door member passes when the door is opened. When the door is opened until the door member reaches the position above the floor member, an attractive magnetic force of a magnet buried in the door member raises a movable piece housed in the floor member so that the movable piece is attached to the magnet of the door member, thereby fixing the door to be retained at the same position.

In the doorstop device disclosed in the above publication, the only force to retain the door is the attractive magnetic force of the magnet which attracts the movable piece of the floor member. Therefore, if the door is shaken by wind pressure or subjected to a strong force, the movable piece may be detached from the magnet and cause the door to close unintentionally. In particular, the force to move the door in a closing direction easily detaches the movable piece from an engaging section of the door member. Thus, the doorstop function of the doorstop device is insufficient to maintain the door in an open state at a predetermined fixed state. designed to be detachable from the door member body so that only the fixing member may be replaced when the member is deteriorated, worn, or damaged.

The fixing member of the door member and the movable piece of the floor member may be further provided with engaging sections which engage with each other. Such engaging sections further enhance the function of preventing the movable piece attached to the magnet from detaching.

BRIEF DESCRIPTION OF THE DRAWINGS

FIG. 13 is a vertical sectional view showing another embodiment of the

SUMMARY OF THE INVENTION

An object of the present invention is to provide a doorstop device which can automatically and securely fix a door when the door is open.

The doorstop device of the present invention for fixing a door in an open state comprises a door member mounted on a bottom side of a door and a floor member buried in a floor face under a route over which the door member passes when the door is opened, said door member provided with a magnet for attracting a movable piece housed in the floor member, wherein said door member has a fixing member for fixing said movable piece.

According to the above construction, when the door is opened and the door member mounted on the bottom side of the door reaches the position above the floor member buried in the floor face, the movable piece of the floor member projects or is attracted up from the floor face by an attractive magnetic force of the magnet of the door member to attach to the magnet and is fixed by the fixing member. Thus, the door can be automatically and securely fixed and retained at the same position. In the doorstop device of the present invention, in particular, since the fixing member is provided in the door member to fix the movable piece attached to the magnet, the movable piece is not easily detached from the door member when the door is shaken or subjected to a force in a closing direction.

The fixing member for fixing the movable piece of the floor member to the door member may be a fixing member that holds the movable piece by elastically pressing the movable piece attached to the magnet of the door member. By the fixing member of such construction, the movable piece attached to the magnet is further pressed by an elastic force, thereby preventing the movable piece from being detached from the door member. The fixing member may be doorstop device of the present invention.

DESCRIPTION OF THE PREFERRED EMBODIMENT

Figure 1:
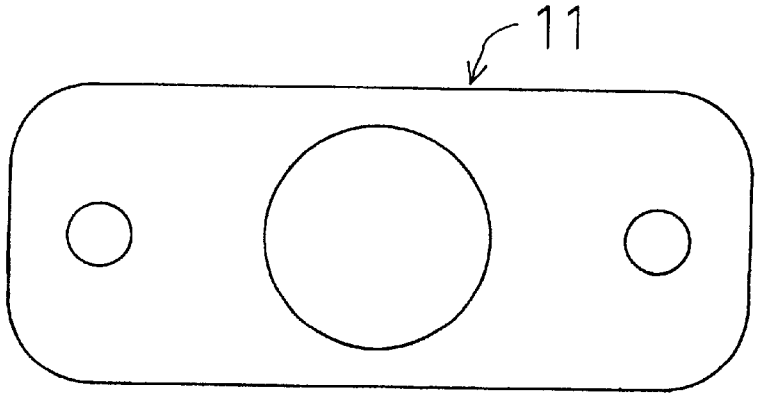
FIG. 1 is a plan view of a door member which constitutes an embodiment of the doorstop device of the present invention.
Figure 2:
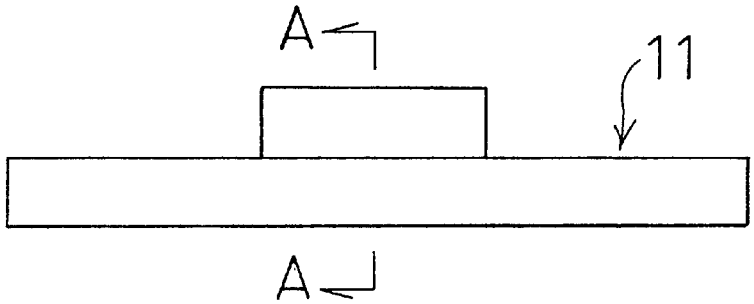
FIG. 2 is a front view of the door member shown in FIG. 1.
Figure 3:
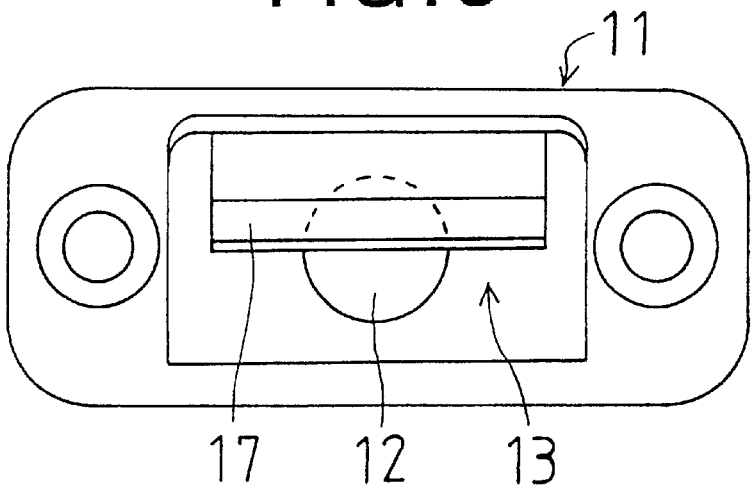
FIG. 3 is a bottom view of the door member shown in FIG. 1.
Figure 4:
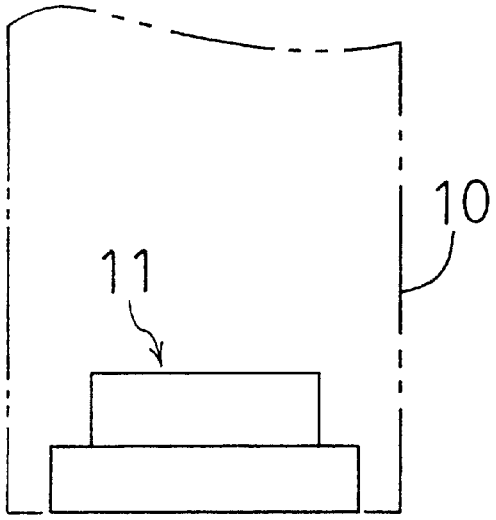
FIG. 4 is a side view of the door member shown in FIG. 1.
Figure 5:
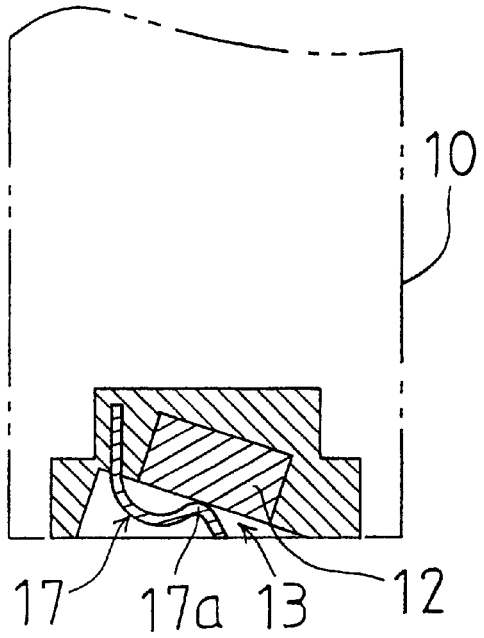
FIG. 5 is a sectional view taken along the line A—A of FIG. 2.
Figure 6:
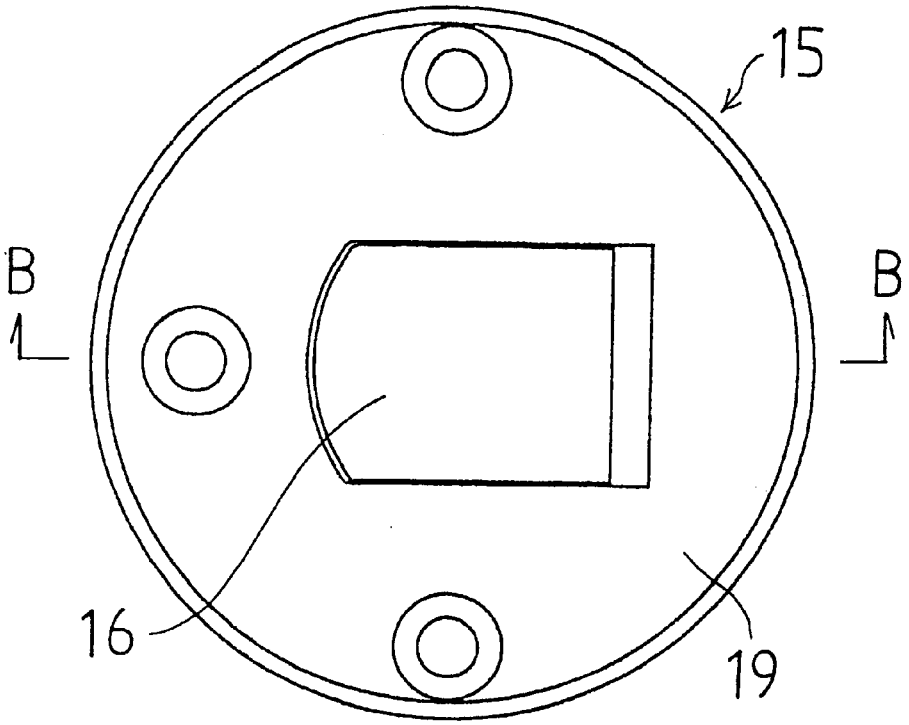
FIG. 6 is a plan view of a floor member which constitutes the embodiment of the doorstop device of the present invention.
Figure 7:
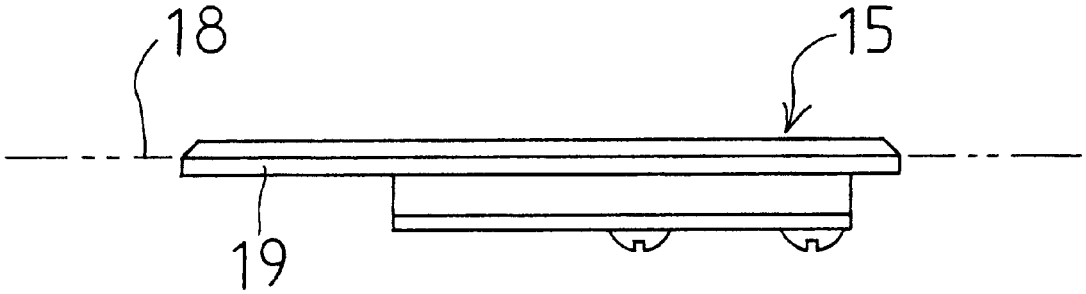
FIG. 7 is a side view of the floor member shown in FIG. 6.
Figure 8:
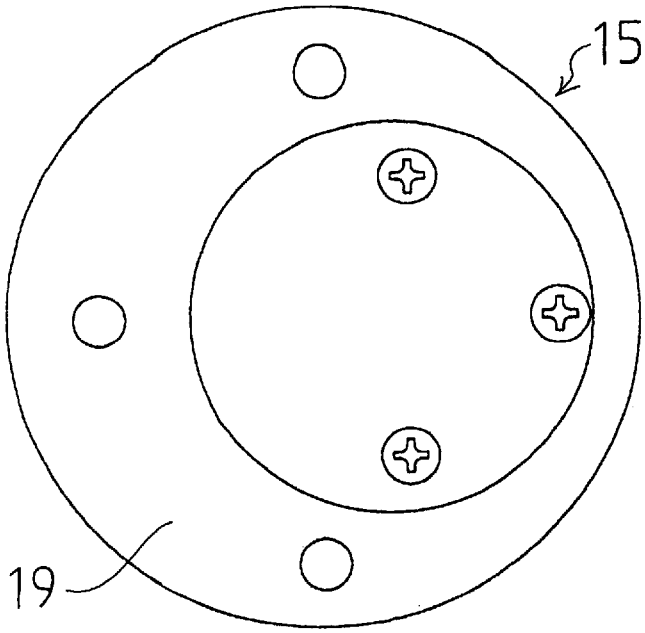
FIG. 8 is a bottom view of the floor member shown in FIG. 6.
Figure 9:
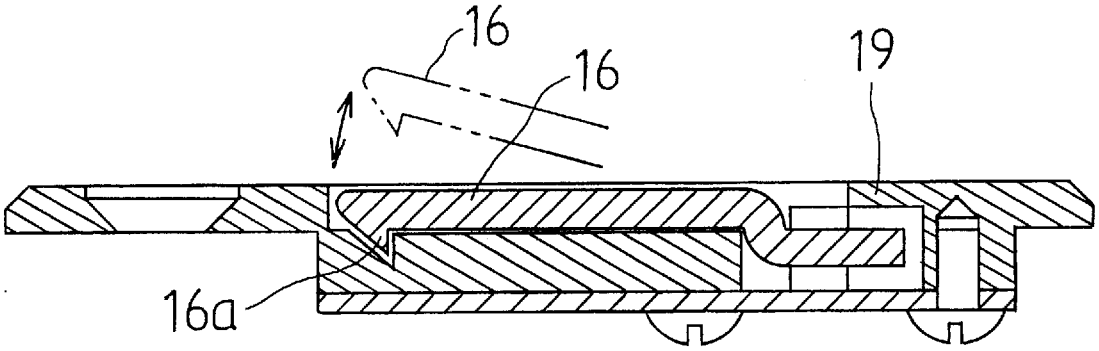
FIG. 9 is a sectional view taken along the line B—B of FIG. 6.

FIGS. 1 to 5 show a door member which constitutes an embodiment of the doorstop device of the present invention, in which FIG. 1 is a plan view; FIG. 2 is a front view; FIG. 3 is a bottom view; FIG. 4 is a side view; and FIG. 5 is a sectional view taken along the line A—A of FIG. 2. FIGS. 6 to 9 show a floor member which constitutes the embodiment of the doorstop device of the present invention, in which FIG. 6 is a plan view; FIG. 7 is a side view; FIG. 8 is a bottom view; and FIG. 9 is a sectional view taken along the line B—B of FIG. 6.

The doorstop device of this embodiment comprises a door member 11 mounted on a bottom side of a door 10 and a floor member 15 buried in a floor face 18 under a route over which the door member 11 passes when the door 10 is opened.

The door member 11 is provided with a magnet 12 which attracts a movable piece 16 included in the floor member 15 so that the movable piece 16 can project from and retract into the floor member 15, a recessed section 13 to receive a tip portion of the movable piece 16, and an elastic fixing member 17 in the form of a thin plate which elastically presses and holds the movable piece 16 attached to the magnet 12. On an end portion of the elastic fixing member 17, an engaging section 17*a* that curves towards the recessed section 13 is formed.

The floor member 15 comprises a casing 19 buried in the floor face 18 and the movable piece 16 which is housed in the casing 19 so as to project from and retract into a surface of the casing 19 and is attracted to the magnet 12 of the door member 11 by an attractive magnetic force of the magnet 12. At the tip portion of the movable piece 16, an engaging section 16*a* protrudes downward so as to engage with the engaging section 17*a* of the elastic fixing member 17.

Figure 10:
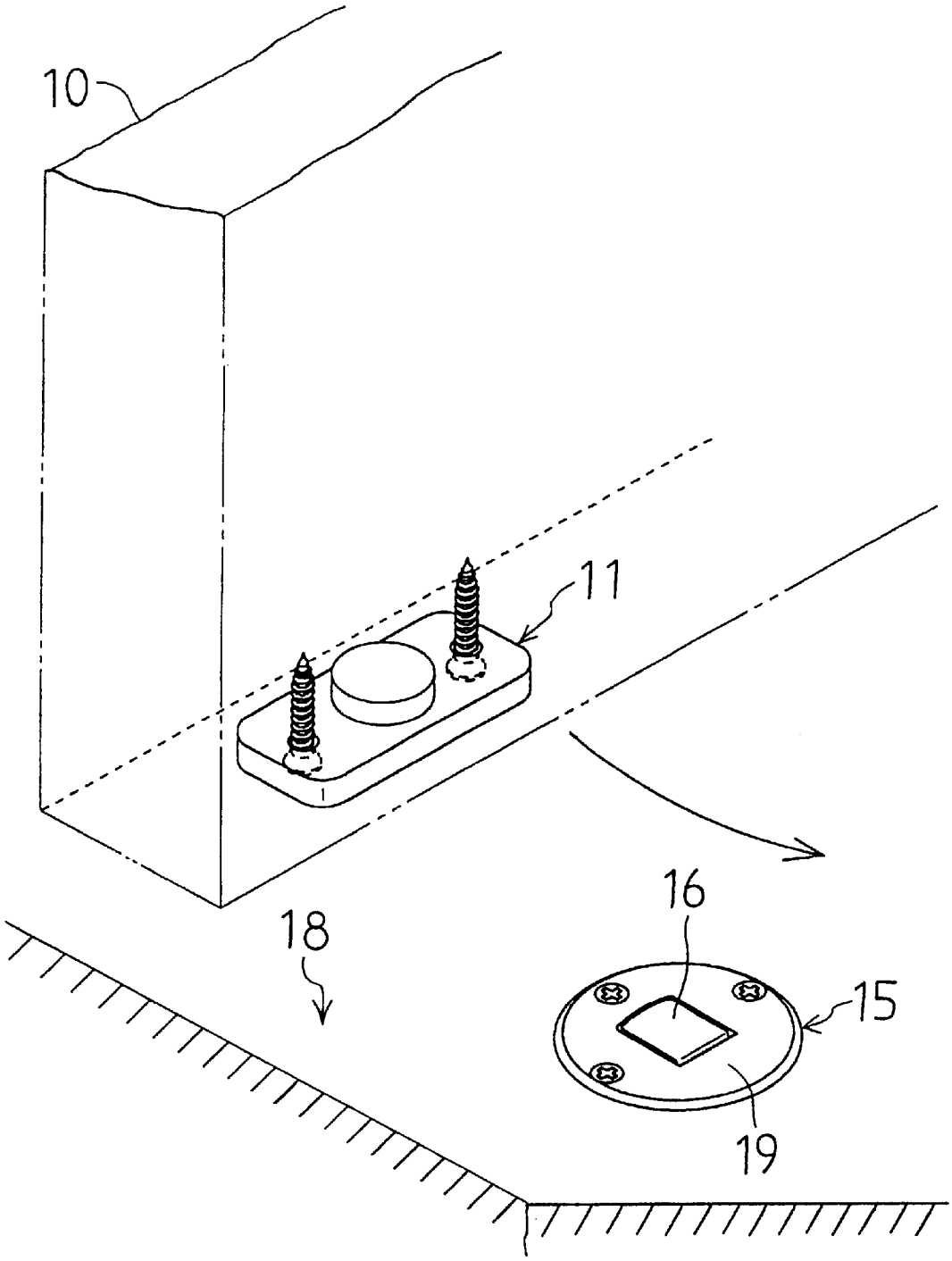
FIG. 10 is a perspective view illustrating the doorstop device of the embodiment in use.
Figure 11:
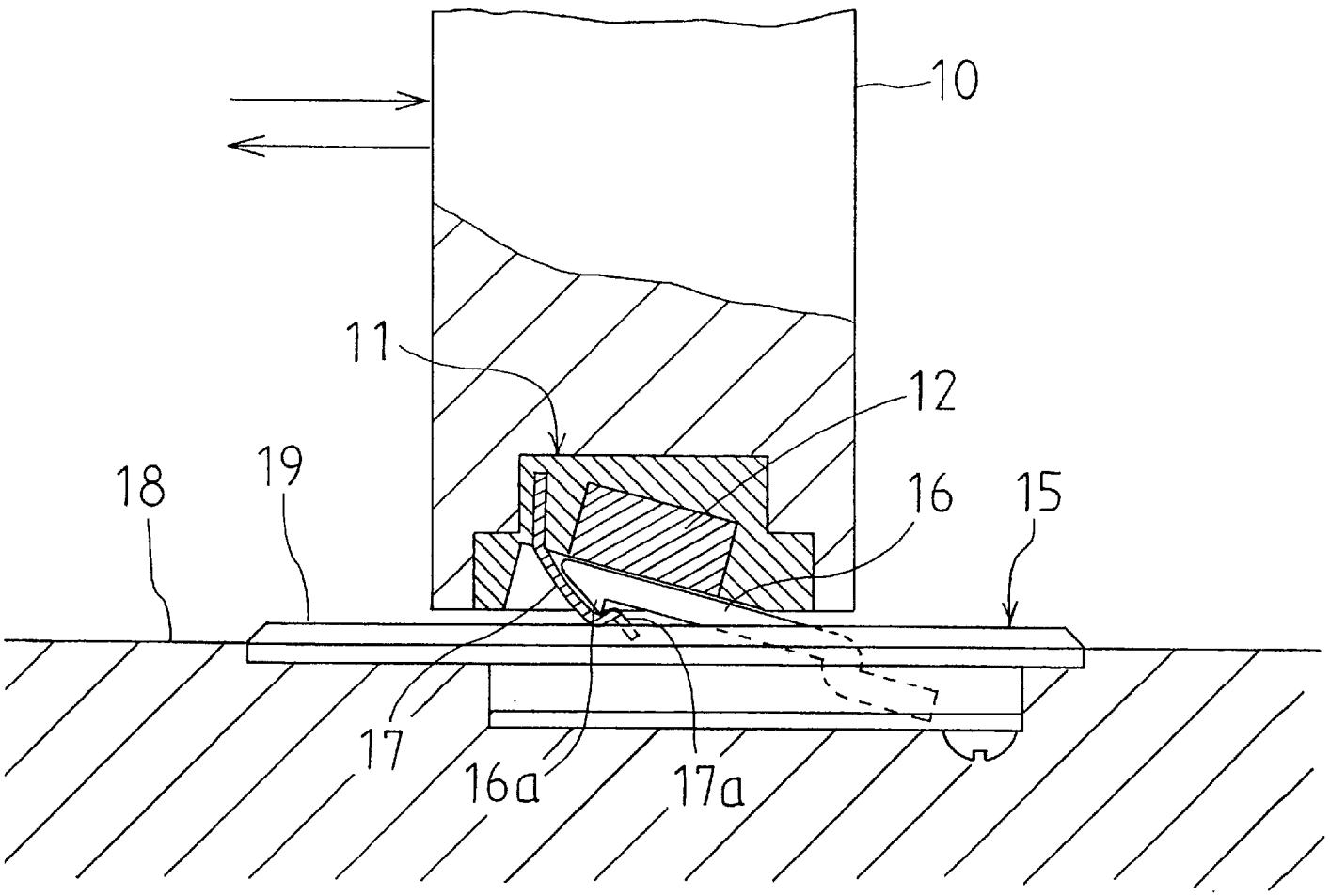
FIG. 11 is a side view illustrating a state of engagement of the doorstop device of the embodiment.

When using the doorstop device of this embodiment, as shown in FIG. 10, the door member 11 is fixed to the bottom side of the door 10, and the floor member 15 is buried in the floor face 18 under the route over which the door member 11 passes when the door 10 is opened. When the door 10 is opened until the door member 11 reaches the position above the floor member 15, as shown in FIG. 11, the movable piece 16 projects from the floor member 15 by an attractive magnetic force of the magnet 12 to be attached to the magnet 12, and the engaging section 16*a* of the movable member 16 engages with the engaging section 17*a* of the elastic fixing member 17. Thus, the movable piece 16 is fixed to the magnet 12 in a state that the movable piece 16 is included in the recessed section 13 of the door member 11, being pressed and held by the elastic fixing member 17, thereby fixing the door 10 to be retained at the same position.

Figure 12A:
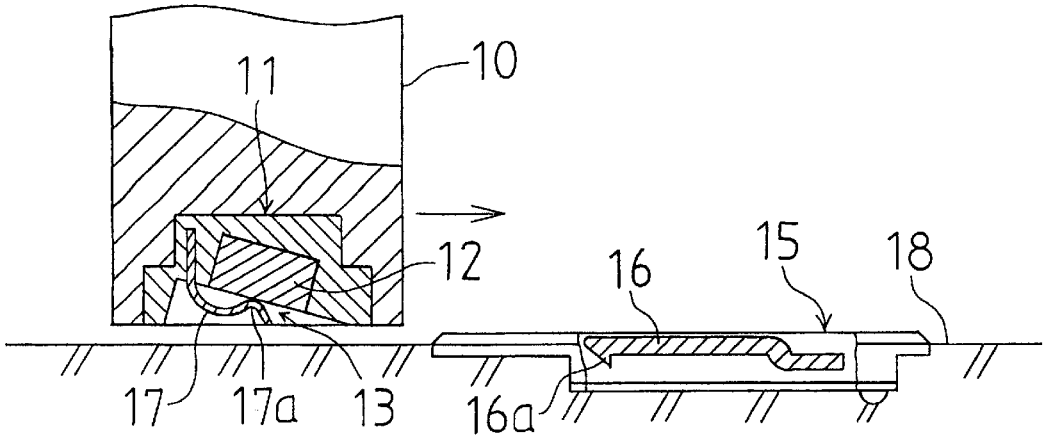
FIGS. 12A, 12B and 12C show an engaging process of the doorstop device of the embodiment.
Figure 12B:
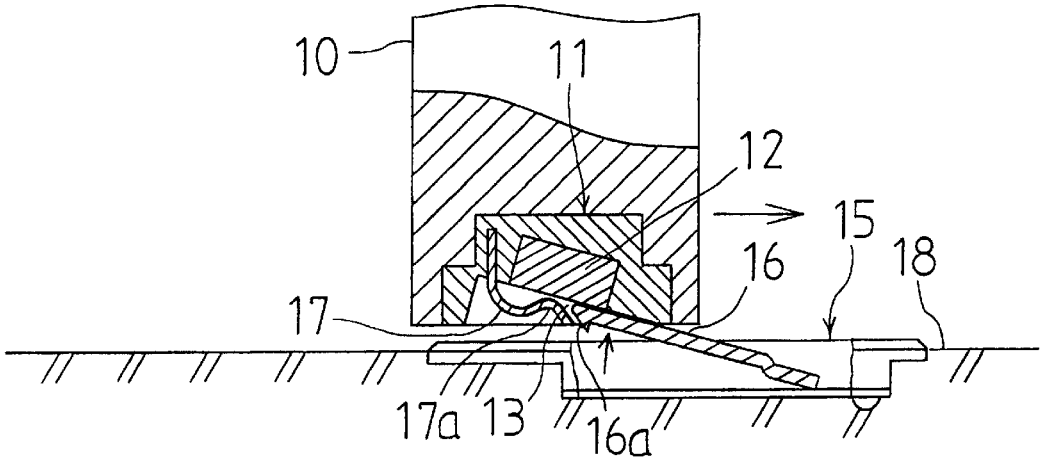

Referring to FIGS. 12A–12B, an engaging process of the door member 11 with the floor member 15 will be explained below. As shown in FIG. 12A, as the door 10 is opened, the door member 11 approaches the floor member 15. When the door member 11 reaches the position where the attractive magnetic force of the magnet 12 acts on the movable piece 16, the movable piece 16 projects and the tip portion thereof is attached to the magnet 12 as shown in FIG. 12B.

Figure 12C:
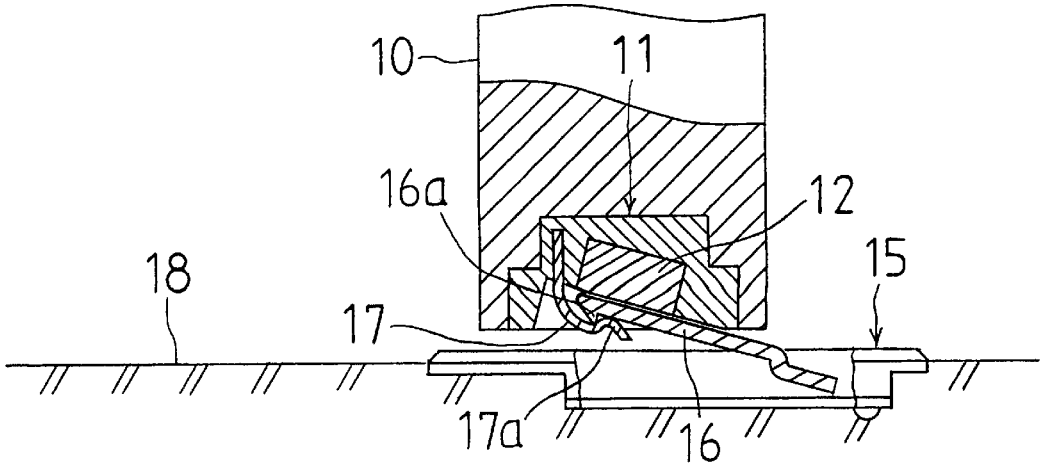

Then, as the door 10 is further opened, the tip portion of the movable piece 16 enters between the elastic fixing member 17 and the recessed section 13 and, as shown in FIG. 12C, the engaging section 16*a* of the movable piece 16 engages with the engaging section 17*a* of the elastic fixing member 17. Thus, the movable piece 16 is fixed to the magnet 12, being included in the recessed section 13 of the door member 11, and is pressed and held by the elastic fixing member 17, thereby fixing the door 10 to be retained at the same position.

As described above, the door that was opened at a predetermined angle can be automatically and securely fixed and retained at the same position merely by opening the door 10 in a normal operation. When the door 10 is shaken or subjected to a force in a closing direction, the movable piece 16 is not easily detached from the door member 11. To close the door 10, a slightly stronger force than the force to open the door 10 is given to the door 10. Then, engaging section 16*a* of the movable piece 16 is detached from the engaging section 17*a* of the elastic fixing member 17, and the whole body of the movable piece 16 separates from door member 11. In this way, the door 10 can be closed in a normal operation.

Figure 13:
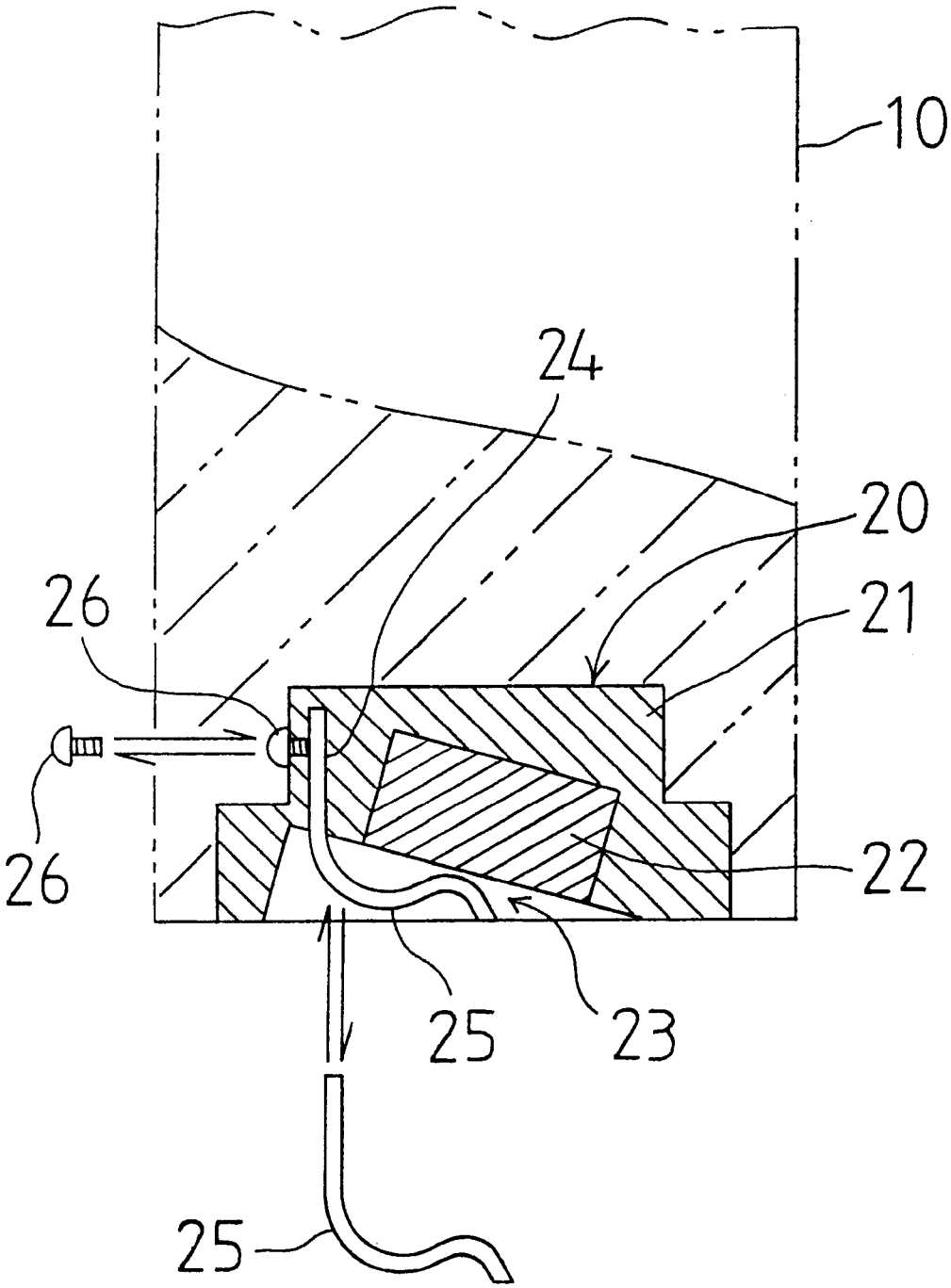

Next, referring to FIG. 13, another embodiment of the door member of the present invention will be explained. A door member 20 is mounted on a bottom side of the door 10 when used in the case of the above described door member 11. The door member 20 is provided with a magnet 22 for attracting the movable piece 16 which is buried in the floor member 15 so as to project from and retract into the floor member 15, a recessed section 23 to receive the tip portion of the movable piece 16, and an elastic fixing member 25 in the form of a thin plate or spring clip for pressing and holding the movable piece 16 attached to the magnet 22. The form and function of the elastic member 25 are the same as those of the elastic fixing member 17 of the door member 11.

In this embodiment, a base end of the elastic fixing member 25 is inserted into a slit 24 formed on a body 21 of the door member 11 and fixed by a fixing screw 26 screwed in a screw hole formed on a front side of the body 21. By loosening the fixing screw 26, the elastic fixing member 25 can be detached from the slit 24.

Accordingly, when the elastic fixing member 25 is deteriorated or worn after long use or damaged by a shock, only the elastic member 25 need be detached from the slit 24 by loosening the fixing screw 26 and replaced with a new member. The structures and functions of the other sections are the same as those of the door member 11.

While particular embodiments of the present invention have been shown and described, numerous variations and alternate embodiments will occur to those skilled in the art. Accordingly, it is intended that the invention be limited only by the appended claims.

What is claimed is:

1. A doorstop device for fixing a door to a floor face in an open state comprising:

a door member adapted to be mounted on a bottom side of the door;

a floor member adapted to be buried in the floor face under a route over which the door member passes when the door is opened;

a movable piece housed in the floor member;

said door member having a magnet for attracting said movable piece; and said door member having a fixing member for holding said movable piece in a fixed position.

2. The doorstop device according to claim 1, wherein said fixing member for holding the movable piece of the floor member to the door member holds said movable piece by elastically pressing the movable piece attracted to said magnet of the door member.

3. The doorstop device according to claim 2, wherein said fixing member of the door member and said movable piece of the floor member have engaging sections which engage with each other.

4. The doorstop device according to claim 1, wherein said fixing member of the door member and said movable piece of the floor member have engaging sections which engage with each other.

5. The doorstop device according to claim 4, wherein said engaging section of said movable piece is a tooth.

6. The doorstop device according to claim 1, further comprising said door member having a slanted recessed section, wherein the magnet is in the bottom of the recessed section.

7. The doorstop device according to claim 1, wherein said fixing member is a thin plate.

8. The doorstop device according to claim 1, wherein said fixing member is a spring clip.

9. The doorstop device according to claim 1, wherein said fixing member is detachably mounted to said door member.

10. The doorstop device according to claim 1, wherein said movable piece pivots.

11. A doorstop device for fixing a door to a floor face in an open state comprising:

a door member adapted to be mounted on a bottom side of the door;

a floor member adapted to be buried in the floor face under a route over which the door member passes when the door is opened;

a movable piece housed in the floor member;

said movable piece having an engaging section;

said door member having a magnet for attracting said movable piece;

said door member having a recessed section for holding said magnet;

said door member having a fixing member for holding said movable piece in a fixed position; and said fixing member having an engaging section for engaging with the engaging section of the movable piece.

12. The doorstop device according to claim 11, wherein said recessed section is slanted.

13. The doorstop device according to claim 11, wherein said fixing member is a thin plate.

14. The doorstop device according to claim 11, wherein said fixing member is a spring clip.

15. The doorstop device according to claim 11, wherein said fixing member is detachably mounted to said door member.

16. The doorstop device according to claim 11, wherein said movable piece pivots.

17. The doorstop device according to claim 11, wherein said engaging section of said movable piece is a tooth.

* * * * *